US010766294B2

(12) United States Patent
Rauscher et al.

(10) Patent No.: US 10,766,294 B2
(45) Date of Patent: Sep. 8, 2020

(54) VALUE DOCUMENT HAVING SECURITY MARKING AND METHOD FOR IDENTIFYING THE SECURITY MARKING

(71) Applicant: GIESECKE+DEVRIENT CURRENCY TECHNOLOGY GMBH, Munich (DE)

(72) Inventors: Wolfgang Rauscher, Parkstetten (DE); Wolfgang Deckenbach, Schechen (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 16/332,869

(22) PCT Filed: Sep. 14, 2017

(86) PCT No.: PCT/EP2017/001087
§ 371 (c)(1),
(2) Date: Mar. 13, 2019

(87) PCT Pub. No.: WO2018/050283
PCT Pub. Date: Mar. 22, 2018

(65) Prior Publication Data

US 2019/0358990 A1 Nov. 28, 2019

(30) Foreign Application Priority Data

Sep. 14, 2016 (DE) ..... 10 2016 011 180

(51) Int. Cl.
*G07D 7/1205* (2016.01)
*B42D 25/378* (2014.01)
(Continued)

(52) U.S. Cl.
CPC ..... *B42D 25/378* (2014.10); *B42D 25/373* (2014.10); *G07D 7/1205* (2017.05);
(Continued)

(58) Field of Classification Search
CPC .. G07D 7/1205; G07D 2207/00; B42D 25/21; B42D 25/23; B42D 25/24;
(Continued)

(56) References Cited

U.S. PATENT DOCUMENTS 7,762,468 B2 7/2010 Jones et al.
7,927,511 B2 4/2011 Giering et al.
(Continued)

FOREIGN PATENT DOCUMENTS

DE 102006047851 A1 4/2008
DE 102007000888 A1 5/2009
(Continued)

OTHER PUBLICATIONS

German Search Report from DE Application No. 102016011180.1, dated Jul. 14, 2017.
(Continued)

*Primary Examiner* — David P Porta
*Assistant Examiner* — Fani Boosalis
(74) *Attorney, Agent, or Firm* — Workman Nydegger

(57) ABSTRACT

A value document has a security marking in the form of at least two luminescing substances which are present in a defined relative quantitative share and are jointly excitable by one excitation pulse. The time courses of the intensities are different and at least one luminescing substance has a non-monoexponential time course. In a method for identifying the security marking, the time course of the total intensity is detected and a linear combination of a formula is adapted including time courses of the intensities of the luminescing substances. The security marking is identified on the basis of the linear coefficients.

15 Claims, 8 Drawing Sheets

(51) Int. Cl.

| | |
|---|---|
| ***B42D 25/373*** | (2014.01) |
| *B42D 25/21* | (2014.01) |
| *B42D 25/23* | (2014.01) |
| *B42D 25/24* | (2014.01) |
| *B42D 25/29* | (2014.01) |
| *B42D 25/355* | (2014.01) |

(52) U.S. Cl.
CPC ..... *B42D 25/21* (2014.10); *B42D 25/23* (2014.10); *B42D 25/24* (2014.10); *B42D 25/29* (2014.10); *B42D 25/355* (2014.10); *G07D 2207/00* (2013.01)

(58) Field of Classification Search
CPC .... B42D 25/29; B42D 25/355; B42D 25/373; B42D 25/378
See application file for complete search history.

(56) References Cited

U.S. PATENT DOCUMENTS

| | | | |
|---|---|---|---|
| 8,367,188 | B2 | 2/2013 | Heer et al. |
| 8,384,628 | B2 | 2/2013 | Mathea et al. |
| 9,046,486 | B2 | 6/2015 | Carr et al. |
| 2004/0031931 | A1 | 2/2004 | Muller et al. |
| 2007/0202352 | A1 | 8/2007 | Giering et al. |
| 2008/0252065 | A1 | 10/2008 | Giering et al. |
| 2010/0026991 | A1 | 2/2010 | Heer et al. |
| 2010/0295878 | A1 | 11/2010 | Mathea et al. |
| 2014/0001351 | A1* | 1/2014 | Carr ..... G01N 21/6408 250/271 |
| 2017/0358163 | A1* | 12/2017 | Clara ..... G07D 7/1205 |

FOREIGN PATENT DOCUMENTS

| | | | |
|---|---|---|---|
| EP | 1158459 | A1 | 11/2001 |
| EP | 1616929 | A2 | 1/2006 |
| EP | 1632908 | A1 | 3/2006 |
| WO | 9916009 | A1 | 4/1999 |
| WO | 0188846 | A1 | 11/2001 |
| WO | 2005035271 | A2 | 4/2005 |
| WO | 2005036479 | A2 | 4/2005 |
| WO | 2011082794 | A1 | 7/2011 |
| WO | 2013012656 | A1 | 1/2013 |

OTHER PUBLICATIONS

International Search Report from PCT Application No. PCT/EP2017/001087, dated Nov. 22, 2017.

* cited by examiner

VALUE DOCUMENT HAVING SECURITY MARKING AND METHOD FOR IDENTIFYING THE SECURITY MARKING

BACKGROUND

The present invention is in the technical field of manufacturing and checking value documents and relates to a value document having a security marking as well as to a method for the identification of the same.

Value documents are normally protected against an undesirable and often illegal duplication by a special label. It has been known for a long time to provide value documents for this purpose with luminescing substances having a specific emission behaviour.

The print WO 9916009 A1 describes the authenticity verification of a value document through a determination of the luminescence decay time of a security marking. Here, the security marking is excited in pulsed fashion and the time after the end of the excitation pulse, which passes until a predefined luminescence intensity is achieved, is determined.

Another method for the authenticity verification of a value document through a determination of the luminescence decay time of a security marking is disclosed in the print WO 0188846A1. In this method, the luminescence intensity is measured at several points in time after switching off an excitation pulse in order to determine the decay curve and to compare this with a target curve.

The print U.S. Pat. No. 7,762,468 B2 shows an authentication method in which a combination of two luminescent substances having different decay times is used. In this method, the second, more slowly decaying luminescent substance is captured only when the luminescence of the first luminescent substance has already decayed.

From the print DE 102006047851 A1 there can likewise be inferred the evaluation of a security marking having luminescent substances with different decay behaviours and overlapping emission spectra. In this method, the temporal course of the luminescence intensities is measured and for authentication the shape of the curve is compared to target values.

The print U.S. Pat. No. 9,046,486 B2 discloses a security marking and a method for identifying the same based on combinations of quasi-resonant luminescent substances having different exponential decay behaviours. With the help of a non-linear adaptation the amplitudes as well as the decay times are determined. The described method is not suitable for marking substances having a strongly non-exponential decay behaviour, which limits the number of available marking substances. Likewise, the analysis by means of non-linear adaptation turns out to be time-consuming and error-prone with respect to noise, so that the speed and quality of the evaluation is low.

With the luminescent substances and evaluating methods known in the prior art there can be achieved a satisfactory solution for the forgery-proof labelling of value documents, but, however, it is disadvantageous in particular in the case of luminescent substances having non-exponential decay behaviour that the combinatorial variety of the available luminescent substances is limited. This causes a restricted variability of the labelling, which may result, among other things, in a decrease of the forgery resistance. If luminescent substances having complex time behaviour are used as base substances for the coding of mixtures with different decay behaviours, the hitherto known evaluating methods, as they are known for example from the print U.S. Pat. No. 9,046,486B2, are unsuitable for securely assessing such security features in time-critical situations, as for example on high-speed bank note processing machines.

SUMMARY

By way of contrast, the object of the present invention is to make possible a reliable, secure and fast identification of the label of a value document having luminescent substances having complex time behaviour. Moreover, the use of a plurality of different luminescing substances having non-exponential time behaviour should be possible.

These and further objects are achieved according to the proposal of the invention by a value document having a security marking as well as by a method for the identification of the same with the features of the independent patent claims. Advantageous configurations of the invention are stated by the features of the subclaims.

According to the invention, a value document having a security marking (label) is shown. The term "value document" is understood within the context of the present invention to be any objects to be protected against an undesirable or illegal duplication, for example bank notes, cheques, shares, value stamps, identity cards, credit cards, and passports, as well as tags, seals, packagings or other objects for value protection. To the security marking of the value document according to the invention there can be assigned at least one arbitrarily definable (binary) property of the value document, the property being given in the case of identification (presence of security marking) and not given in the case of non-identification (lacking of security marking). For example, the security marking can be assigned as an authenticity marking or authenticity feature to the property "authenticity", in order to recognize value documents as either authentic or forged. It is also conceivable that, by the security marking, value documents are assigned for example to a particular class or group, such as for example to the bank note's value or country of manufacture.

According to the invention, the security marking is configured in the form of at least two luminescing substances (hereinafter also referred to as luminescent substances). The luminescent substances can be incorporated into the value document or attached to the value document in a great variety of ways. The luminescent substances can for example be admixed to a paper or plastic mass for manufacturing the value document or to a printing ink for printing the value document. It is also conceivable to provide the luminescent substances as a for example invisible coating on the value document. The luminescent substances can also be provided on or in a carrier material for example consisting of plastic, which is embedded in a paper or plastic mass for manufacturing the value document. The carrier material can be configured, for example, in the form of a security thread or tracer thread, a mottling fiber or planchet. Likewise, the carrier material can be attached to the value document for example in the form of a patch, for example as a product authentication measure. Basically, any arbitrary design of the carrier material is possible.

The at least two luminescent substances of the security marking are jointly excitable by one (same) excitation pulse (e.g. light flash). What is essential here is that the time courses of the intensities of the luminescent substances's radiations emitted, excited by the excitation pulse, are different from each other, at least one luminescent substance having a non-monoexponential time course of the intensity of the emitted radiation.

In the security marking, the at least two luminescent substances are included in a definable or defined quantity ratio in combination (preferably in the form of a mixture). This means that each luminescent substance is present in the security marking in a definable or defined, relative quantitative share, based on the total quantity of the luminescent substances. Therefore, with the help of the quantity ratio (mixing ratio) of the luminescing substances the security marking can be identified in unambiguous fashion.

Depending on its relative quantitative share, each luminescent substance contributes, with the intensity of its emitted luminescence radiation, to the total intensity of the simultaneously emitted radiations of the excited luminescent substances of the security marking. The term "total intensity" here and hereinafter refers to a summary intensity of the luminescence radiations excited by one (same) excitation pulse and captured at a same point in time of the luminescent substances included in combination in the security marking.

The security marking is configured such that for an identification of the security marking the quantity ratio (mixing ratio) of the luminescing substances is ascertainable by an analysis of the time course of the total intensity of the emitted luminescence radiations (excited through one excitation pulse) on the basis of the time courses of the intensities of the luminescence radiations (excited at the same excitation pulse) of the luminescent substances.

The use of at least one luminescent substance having a non-monoexponential time course of the intensity of the emitted radiation has the particular advantage that a large variety of in principle suitable substances is available and an improved forgery resistance can be achieved by the specific selection. Moreover, a relatively large difference in the rise behaviour and/or decay behaviour of the luminescent substances can be achieved, which allows a reliable and secure identification of the security marking. If the excitation light is re-emitted with an (anti-) Stokes-shifted wavelength due to intrinsic conversion processes, a clear separation of the excitation radiation and emission radiation is easily possible by suitable filter techniques.

The at least two luminescing substances are particularly advantageously selected such that the intensity of the emitted radiation of each luminescing substance lies in a region of 5% to 95%, preferably 10% to 90%, and particularly preferably 15% to 85%, of the total intensity of the luminescing substances. This makes possible a particularly accurate analysis of the time course of the total intensity of the security marking on the basis of the time courses of the intensities of the luminescence radiations emitted by the respective luminescing substances, which contributes to an improvement of the reliability of the identification of the security feature.

Preferably, the at least two luminescing substances are respectively selected such that the decay time, i.e. in particular the time between the end of the excitation pulse and achieving an intensity of 1/e of the intensity at the end of the excitation pulse, lies in a region of 100 ns to 100 ms, preferably 10 μs to 5 ms. This is advantageous for an accurate analysis of the time course of the total intensity of the emitted luminescence radiations of the luminescing substances on the basis of the time courses of the intensities of the luminescence radiations emitted by the respective luminescing substances, which contributes to a further improvement of the reliability of the identification of the security feature.

Preferably, but not necessarily, the at least two luminescing substances have overlapping, in particular identical, excitation spectra, which makes possible a targeted and relatively strong excitation of the luminescing substances by a comparatively narrow-band excitation pulse (light flash). Particularly preferably, the at least two luminescing substances have overlapping emission spectra, which advantageously further improves the forgery resistance of the security feature due to a significantly more difficult analysis of the emitted radiation.

In a further advantageous configuration of the value document according to the invention, the at least two luminescing substances are configured such that the time courses of the intensities of the emitted radiations have a Bray-Curtis distance of greater than 0.10, preferably greater than 0.20, and particularly preferably greater than 0.25. The Bray-Curtis distance of two vectors $(v_1, \ldots, v_n)$ and $(w_1, \ldots, w_n)$ is here defined as $$\sum_{i=1}^{n} \frac{|v_i - w_i|}{|v_i + w_i|}.$$

This measure likewise can increase the accuracy of the analysis of the time course of the total intensity of the emitted luminescence radiations of the luminescent substances of the security marking on the basis of the time courses of the intensities of the luminescence radiations emitted by the luminescent substances, which contributes to a still further improvement of the reliability of the identification of the security feature.

The luminescing substances of the security marking of the value document according to the invention can basically be selected freely, as long as it is guaranteed that they are jointly excitable by one excitation pulse and the time courses of the emitted radiations of the luminescing substances are different from each other, at least one luminescing substance having a non-monoexponential time course of the intensity of the emitted radiation. The excitation and emission of the luminescing substances can be effected in the UV, VIS and/or IR region. For example, there can be employed luminescing substances which are excited in the UV region and emit in the UV region or visible spectral region. Furthermore, it is possible to use luminescing substances which are excited in the visible spectral region and emit in the visible spectral region or IR region. Additionally, luminescing substances can be employed which are excited in the IR region and emit in the IR region or emit in the visible region (up-converter).

Advantageous according to the invention are luminescing substances which show an especially strongly non-monoexponential decay behaviour after the excitation. Particularly preferred are luminescing substances which respectively comprise a host lattice which is doped with at least one dopant selected from the rare-earth metals and transition metals (or from their ions).

Suitable inorganic host lattices are for example oxides, borates, gallates, phosphates, garnets, perovskites, sulfides, oxysulfides, apatites, vanadates, tungstates, glasses, tantalates, niobates, halides, oxyhalides, especially fluorides, silicates or aluminates.

As host lattices there can be used in particular host lattices such as YAG, ZnS, YGG, YAM, YAP, $AlPO_5$, zeolites, $Zn_2SiO_4$, $YVO_4$, $CaSiO_3$, $KMgF_3$, $Y_2O_2S$, $La_2O_2S$, $Ba_2P_2O_7$, $Gd_2O_2S$, $NaYW_2O_6$, $SrMoO_4$, $MgF_2$, MgO, $CaF_2$, $Y_3GasOi_2$, $KY(WO_4)_2$, $SrAl_{12}O_{19}$, ZBLAN, $LiYF_4$, $YPO_4$, $GdBO_3$, $BaSi_2O_5$ or $SrBeO_7$.

Suitable dopants are for example the rare earth elements La, Ce, Pr, Nd, Sm, Eu, Gd, Tb, Dy, Ho, Er, Tm, Yb, Lu, or Bi, Pb, Ni, Sn, Sb, W, Tl, Ag, Cu, Zn, Ti, Mn, Cr and V (or their ions).

A concrete selection of suitable host lattices/doping ion combinations is described, for example, in the print EP 1632908 A1, to whose entire content reference is made in this regard.

Luminescing substances having a strongly non-monoexponential time behaviour of the intensity of the emitted radiation can be realized by different mechanisms. In particular with luminescent substances having complicated and possibly multi-level energy transfer processes between different doping ions, in particular rare-earth doping ions, there may occur intrinsically multiple time constants in the rise behaviour as well as in the decay behaviour. Such energy transfer processes are known, for example, for the doping-ion combinations Yb/Er, Nd/Yb, Yb/Tm, Cr/Tm, Tm/Ho, Er/Tm, Er/Ho, Yb/Ho, Cr/Ho, Fe/Tm, Mn/Tm, Cr/Er, Fe/Er, Cr/Nd, Cr/Nd, Cr/Yb, in particular in combination with further doping ions. According to the invention, the use of such combinations of doping ions is preferred. The accurate time behaviour of these substances here sensitively depends on the host lattice used (by fine splitting of the position of the energy states involved) as well as on the respective concentrations of doping-ions. The reason for this is a relative change of the coupling rates compared to competing loss processes, such as e.g. a non-radiating recombination of the ions involved.

In particular luminescent substances with complex intrinsic energy transfer processes can show intensity patterns with strongly non-monoexponential time behaviour, whereby the luminescence intensity may still further increase after the termination of the excitation phase. The combination of such substances together with classical substances, which after excitation show a temporally monotonously decreasing behaviour, allows a targeted adjustment of the time behaviour of the total intensity of the luminescent substances. This can have, beside decreasing emission portions, also increases, plateaus, local maxima and/or minima. According to the invention, it may be advantageous when the security marking shows a combination of at least one luminescent substance with non-monoexponential time behaviour and at least one luminescent substance with monoexponential time behaviour of the intensity of the emitted luminescent radiation.

In a further preferred embodiment, the security marking can have a combination of at least two luminescent substances with respectively different non-monoexponential time behaviour of the intensity of the emitted luminescence radiation.

Furthermore, there are luminescent substances in which several different transitions of a doping ion, which are energetically very similar but have different lifetimes, contribute to the emission in a narrow wavelength region. These luminescent substances likewise often show non-monoexponential time behaviour. Examples of this are Pr and Er.

Furthermore, luminescent substances may have non-monoexponential behaviour due to randomly occurring inhomogeneities or inhomogeneities produced in targeted fashion upon manufacture, e.g. an inhomogeneous grain size distribution or an inhomogeneous distribution of the dopants. This may occur, for example, when there arise grains with faster time behaviour, i.e. faster decay time and/or faster rise time, as well as grains with slower time behaviour, i.e. slower decay time and/or slower rise time. Their different properties are averaged upon the relevant macroscopic measurement, upon which in general relatively many individual grains are simultaneously excited and measured. As a result, the individual time structures of the emissions of the individual grains overlap in such a way that altogether there can result a non-monoexponential time behaviour.

By a simple measurement of the time-dependent luminescence of a luminescent substance the person skilled in the art can establish whether or not this has a monoexponential time behaviour. In so doing, the temporal course of the intensity is measured in the decay phase and an exponential curve is adapted to the decay curve. As a measure for the goodness of adaptation there can be used, for example, the coefficient of determination $R^2$, the decay curve being evaluated for example as "non-exponential", if $R^2 \leq 0.98$ applies. Upon measurement, the signal-to-noise ratio at the beginning of the decay curve should be at least 50, so that with a monoexponential decay curve there is not obtained by chance a fit with fit goodness $R^2 \leq 0.98$.

The invention further relates to a method for identifying (i.e. recognizing the presence or non-presence) of the security marking of a value document configured as described above. The method comprises the following steps:

Step i)

Jointly exciting the luminescing substances of the security marking with one (same) excitation pulse.

Step ii)

Detecting the time course of a total intensity of the simultaneously emitted radiations of the luminescing substances excited by the excitation pulse.

Step iii)

Adapting a linear combination I(t) according to the subsequent formula $$I(t) = \sum_{i=1}^{n} c_i \cdot I_i(t)$$

to the time course of the total intensity of the emitted radiations, where $I_i(t)$ are definable or defined time courses of the intensities of the luminescence radiations emitted by the luminescing substances (excited by the same excitation pulse) and $c_i$ are linear coefficients to be adjusted. The running index i refers to the luminescing substances, n indicates the number of luminescing substances and t the time. The time courses $I_i(t)$ of the intensities of the luminescent substances can be determined (in advance) for each luminescent substance by exciting with the same excitation pulse and detecting the luminescence radiation.

For the adaptation of the linear combination I(t) to the time course of total intensity I(t) the linear coefficients $c_i$ are ascertained. The linear coefficients $c_i$ respectively indicate the relative portion of a time course $I_i(t)$ of an individual luminescing substance in the linear combination I(t). From the linear coefficients $c_i$ there can be ascertained the relative quantitative share of each luminescing substance, based on the total quantity of the luminescing substances, in the security marking and therefore the quantity ratio (e.g. mixing ratio) of the luminescing substances in the security marking.

Step iv)

Identifying (i.e. recognizing the presence or non-presence) of the security marking on the basis of the linear coefficients The adaptation of the linear combination I(t), consisting of a sum of the preknown time courses $I_i(t)$ weighted with the linear coefficients $c_i$, to the total intensity I(t) of the simultaneously emitted luminescence radiations makes possible in an advantageous manner an especially simple, reliable and very fast determination of the quantity ratio (e.g. mixing ratio) of the luminescing substances in the security marking, thereby making possible a secure identification of the security marking.

In an advantageous configuration of the method according to the invention, in step iii) the linear coefficients $c_i$ are determined such that absolute deviations of the linear combination I(t) from data points of the detected time course of the total intensity are minimized. Preferably, the linear coefficients $c_i$ are determined by the method of least squares such that the sum of the square deviations of the linear combination I(t) from data points of the detected total intensity are minimized. The person skilled in the art in the field of statistical evaluation of amounts of data is familiar with the method of least squares, so that no further explanation is necessary here. Merely in addition, it is pointed out that this is a statistical standard method for ascertaining a compensation curve to a data record with as low as possible deviation of the data points from the compensation curve.

In a further advantageous configuration of the method according to the invention, step iv) comprises the following substeps:

Substep iv-1)

For n−1 linear coefficients $c_i$: ascertaining a ratio value $M_i$ for each linear coefficient $c_i$, which results from the ratio of the linear coefficient $c_i$ to at least one further linear coefficient $c_i$ (e.g. $c_1/c_2$).

Advantageously, the ratio value $M_i$ is determined by the ratio of the linear coefficient $c_i$ to the sum of at least one, preferably all, linear coefficients $c_i$ (e.g., $c_1/(c_1+c_2)$). For the $n^{th}$ linear coefficient there results the ratio value $M_n$ from $M_n=1-(M_1+\ldots+M_{n-1})$, i.e. from the difference between the number 1 and the sum of the other ratio values $M_i$. The ratio values $M_i$ indicate the quantity ratio (e.g. mixing ratio) of the luminescing substances in the security marking.

Substep iv-2)

For each ratio value $M_i$: checking whether the ratio value $M_i$ lies within an associated, definable or defined values range $W_i$ which advantageously corresponds to a scatter region around the preknown relative quantitative share of the luminescing substance in the security marking.

Substep iv-3)

For each ratio value $M_i$: assigning the attribute "ratio value accepted", if the ratio value $M_i$ lies within the associated values range $W_i$, or the attribute "ratio value not accepted", if the ratio value $M_i$ is outside the associated values range $W_i$.

Substep iv-4)

Identifying (i.e. recognizing the presence of) the security marking, if all ratio values $M_i$ were assigned the attribute "ratio value accepted", or not identifying (i.e. recognizing the non-presence of) the security marking, if at least one ratio value $M_i$ was assigned the attribute "ratio value not accepted".

By the substeps iv-1) to iv-4) a simple and reliable identification of the security marking on the basis of the linear coefficients $c_i$ is possible in advantageous manner.

In a further advantageous configuration of the method according to the invention, this has one further step v) which comprises the following substeps:

Substep v-1)

Ascertaining a measure value G characterizing the goodness of the adaptation of the linear combination I(t) to the time course of the total intensity. Preferably, the coefficient of determination $R^2$ is used as a measure value G. The person skilled in the art in the field of statistical evaluation of amounts of data is familiar with the coefficient of determination $R^2$, so that no further explanation is necessary here. Merely in addition, it is pointed out that the coefficient of determination $R^2$ is a statistical standard method with which the quality of a linear approximation can be ascertained.

Substep v-2)

Comparing the measure value G with a definable or defined threshold value. If the coefficient of determination $R^2$ is used as a measure value G, a lower threshold value of preferably 0.9, particularly preferably 0.95 is used, whereby a high reliability in the identification of the security marking can be achieved.

Substep v-3)

Assigning the attribute "measure value accepted" to the measure value G, if the measure value G is greater than the threshold value, or the attribute "measure value not accepted", if the measure value G is smaller than or equal to the threshold value.

Substep v-4)

Identifying (i.e. recognizing the non-presence of) the security marking, if the measure value G was evaluated with the attribute "measure value accepted", or not identifying (i.e. recognizing the non-presence of) the security marking, if the measure value G was evaluated with the attribute "measure value not accepted".

In case that in step iv) the substeps iv-1) to iv-4) are carried out, for substep v-4) applies:

Identifying the security marking, if all ratio values M were evaluated with the attribute "ratio value accepted" and additionally the measure value G was evaluated with the attribute "measure value accepted", or not identifying (i.e. recognizing the non-presence of) the security marking, if at least one ratio value $M_i$ was evaluated with the attribute "ratio value not accepted" and/or the measure value G was evaluated with the attribute "measure value not accepted".

The reliability of the identification of the security marking can still further be improved in particularly advantageous manner by step v), in particular in connection with the substeps iv-1) to iv-4).

In a further advantageous configuration of the method according to the invention, more data points for detecting the total intensity are captured in a first time period immediately following the switching-off of the excitation pulse than in a second time period immediately following the first time period, the first time period and the second time period being of equal length. This measure makes possible in advantageous manner a high reliability of the identification of the security marking with limited memory resources.

For selecting the luminescing substances and for specifying their defined relative quantitative shares for a value document, for example as stated above, a total intensity in dependence on the time (i.e. the linear combination I(t)) can be defined and be assigned to an information item (e.g. authenticity). The linear combination I(t) is a combination of the time courses of the intensities $I_i(t)$ of the luminescing substances with the linear coefficients $c_i$ of the luminescing substances. Starting out from of the defined linear combination I(t), the quantitative shares of the luminescing substances being specified. Therefore, from the given, desired linear combination I(t) there result a defined quantity ratio and defined quantitative shares of the luminescing substances. For determining and/or selecting the luminescing substances and the defined quantitative shares, in particular the respective time courses of the intensities $I_i(t)$ of the luminescent substances and, where applicable, the respective linear coefficients $c_i$ are viewed and/or evaluated. With the help of a data base, in which the time courses of the intensities $I_i(t)$ are deposited, a combination of the luminescing substances can be defined. Subsequently, with the help of the linear coefficients $c_i$ there can be defined the relative quantitative share of the respective luminescing substance. It can be taken into account here that for adjusting the intensity $I_i(t)$ of the luminescing substance the latter is provided with so-called camouflage substances. The camouflage substances effect a reduction of the luminescence intensity of the luminescing substance, in particular by a temporally constant factor, so that there results, depending on the amount of camouflage substance, from the linear coefficient $c_i$ a different relative quantitative share for the respective luminescing substance.

BRIEF DESCRIPTION OF THE DRAWINGS

The invention will now be explained in more detail on the basis of embodiment examples, reference is made to the enclosed figures. There are shown.

DETAILED DESCRIPTION OF THE IMAGES

Figure 1:
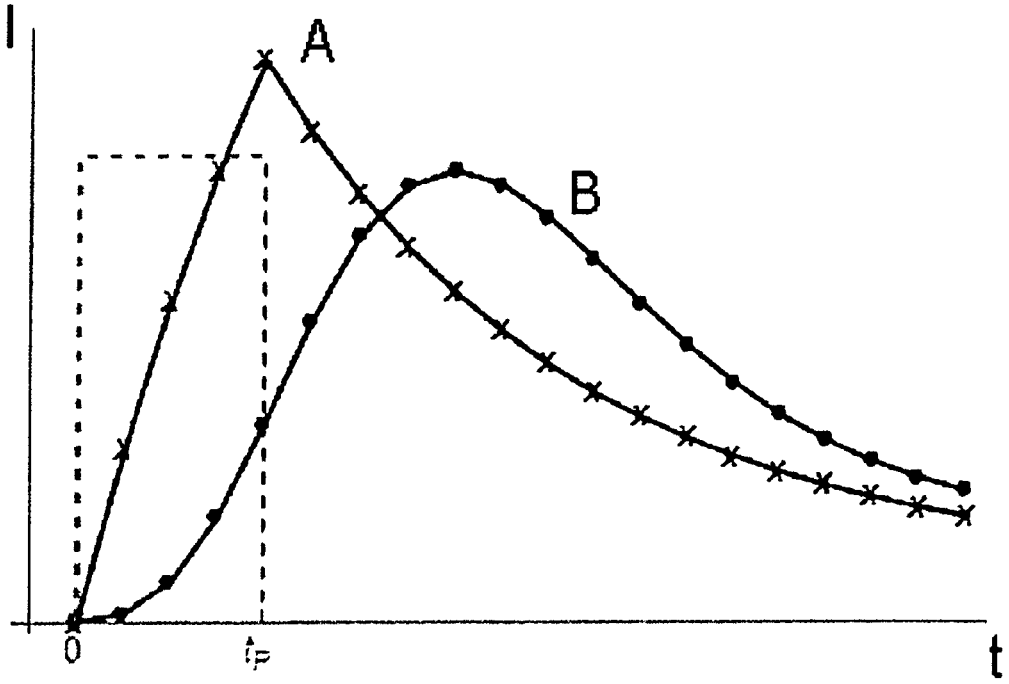
FIG. 1 time courses of the luminescence intensities of two luminescent substances A, B with a different, non-monoexponential emission behaviour.

Referring first to FIG. 1, where by way of example the measured time courses of the intensities of the emitted luminescence radiations of two different luminescent substances A, B are illustrated. The intensity I is plotted against time t (in arbitrary time and intensity units). The measured data points are respectively connected to each other by a continuous data line.

The luminescence radiations of the two luminescent substances A, B are jointly excited by one single or same excitation pulse (light flash). The excitation pulse is switched on at the point in time t=0 and switched off at the point in time $t=t_p$. Time duration and intensity of the excitation pulse are illustrated by the dashed lines. The duration of the light flash is preferably in the region of 10 μs to 10 ms and is for example 40 μs.

The time courses of the intensities of the two luminescent substances A, B respectively have a rise phase in which the intensity increases from zero up to a maximum value, as well as a decay phase in which the intensity decreases from the maximum value. The intensity of the luminescent substance A recognizably reaches a maximum value at the point in time $t=t_p$, so that the rise phase ends when the excitation pulse is switched off. Unlike the luminescent substance B whose intensity reaches a maximum value only after the switching off of the excitation pulse. The time courses of the intensities of the two luminescent substances differ strongly from each other, both luminescent substances showing a non-monoexponential emission behaviour. The time courses of the intensities of the two luminescent substances have a Bray-Curtis distance of 0.25 which reflects a low and thus preferred correlation behaviour of the two emission courses.

Figure 2:
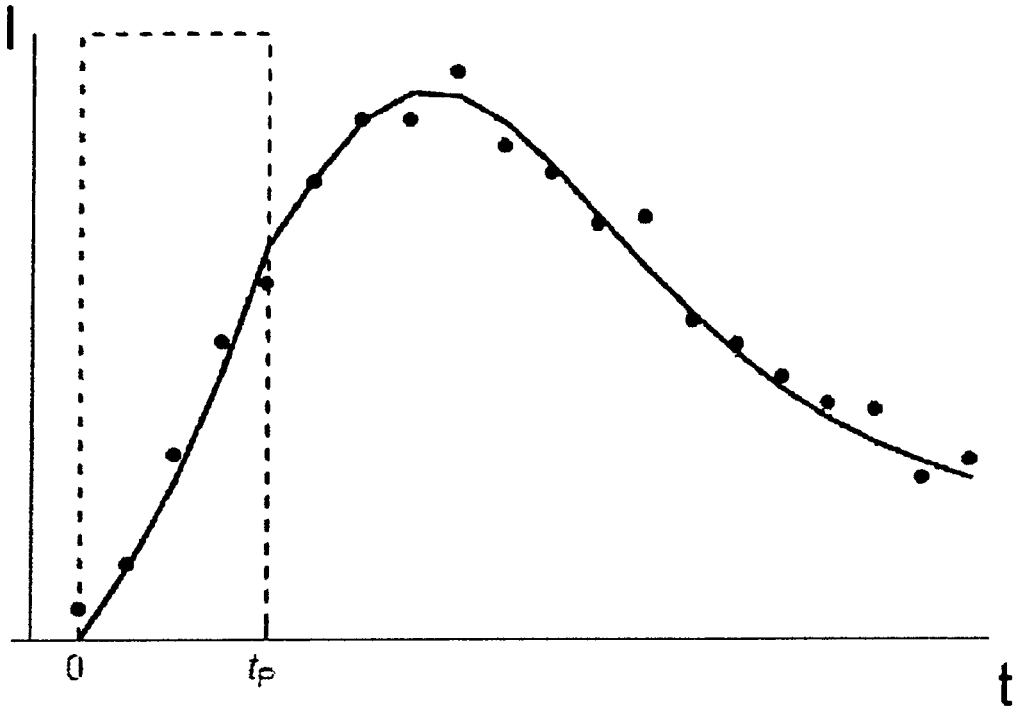
FIG. 2 a time course of the total intensity of the luminescent radiations of a combination of the two luminescent substances A, B of FIG. 1, with adaptation curve.

FIG. 2 shows the measured time course of the total intensity of the simultaneously emitted radiations of a mixture of the two luminescent substances A, B in the I-t diagram. The combination of the two luminescent substances A, B can be employed as a security marking for a value document. Furthermore, there are represented the excitation pulse for the joint excitation of the two luminescent substances A, B (which is equal to the excitation pulse in FIG. 1) as well as an adaptation curve drawn with a solid line. In the mixture of the luminescent substances, the luminescent substance A is present with a mixture share of 30% and the luminescent substance B with a mixture share of 70%, in each case based on the total quantity of the luminescent substances A, B. The (preknown) quantity ratio (mixing ratio) of the luminescent substances A, B therefore is 30%/70%. The rise phase of the total intensity of the emitted radiations continues until after $t=t_p$; a maximum value of the total intensity is achieved only after the switching off of the excitation pulse.

The measurements of the total intensity take place at defined points in time. The measurements can be effected at equidistant points in time, but also at non-equidistant points in time, the latter offering the advantage that for example in the case of limited memory resources in the proof sensor there can be selected a reduced amount of data without significantly impairing the adaptation goodness. For this, preferably in time segments in which the intensity patterns of the base substances strongly differ, more measuring points are taken, whereas during the decay phase long after the excitation, when the luminescence has decayed quite strongly, fewer measuring points are taken.

The measured time course of the total intensity I(t) is evaluated by adapting a linear combination of the general formula $$I(t)=\Sigma_{i=1}^{n} c_i \cdot I_i(t) \quad \text{(A).}$$

The formula (A) used for the linear adaptation is a linear combination of (sampled) base vectors $I_i(t)$. The running index i characterizes the luminescent substances. In the present case, n=2, i.e. i=1 and i=2, corresponding to the two luminescent substances A, B. The base vectors $I_i(t)$ are definable or defined (preknown) time courses of the luminescent substances used and result preferably from temporal intensity measurements of the luminescent substances used ascertained in advance. The base vectors $I_i(t)$ are to be respectively weighted with the associated linear coefficients $c_i$. In the present embodiment example, the base vectors $I_i(t)$ correspond to the preknown time courses $I_A(t)$, $I_B(t)$ of the two luminescent substances A, B, as they are shown in FIG. 1.

An adaptation of the linear combination I(t) to the data points of the measured total intensity requires a determination of the linear coefficients $c_i$, which in the present case is effected with the method of least squares (least square fit method). This allows the linear coefficients $c_i$ to be ascertained efficiently with a good adaptation of the compensation curve. From the linear coefficients $c_i$ there result the relative mixture shares of the employed luminescent substances in the security marking, respectively based on the total quantity of luminescent substances. The evaluation yields a mixture share of 28.8% for the luminescent substance A and a mixture share of 71.2% for the luminescent substance B, corresponding to a quantity ratio (mixing ratio) A/B=28.8%/71.2%.

For an identification of the security marking, the ascertained linear coefficients $c_i$ are combined as 2-tuple c) and are converted into a scaling-independent value, a ratio value $M_i$. The ratio value $M_1$ results from the linear coefficients $c_1$, $c_2$ as follows: $M_1=c_1/(c_1+c_2)$. Accordingly, for the first linear coefficient $c_1$, the ratio to the sum of the two linear coefficients $c_1$ and $c_2$ is formed. For the second linear coefficient $c_2$, the associated ratio value $M_2$ results from $M_2=1-M_1$. Subsequently, for the ratio value $M_1$ or $M_2$ there is checked, whether the ratio value lies within an associated definable or defined (predetermined) values range $W_1$ or $W_2$. The values ranges $W_1$, $W_2$ respectively indicate a scatter region around the preknown mixture shares of the luminescent substances A, B in the security marking. For the checked ratio value $M_1$ or $M_2$ there is then effected an assignment of the attribute "ratio value accepted", if the ratio value is within the associated values range, or the attribute "ratio value not accepted", if the ratio value is outside the associated values range. In the present case, the ratio values $M_1$, $M_2$ are within the associated values ranges $W_1$, $W_2$, i.e. within the frame of the scatter there were ascertained the correct, i.e. preknown mixture shares of the two luminescent substances A, B, respectively based on the total quantity of the luminescent substances A, B, or the preknown quantity ratio (mixing ratio) A/B.

Furthermore, the goodness of the adaptation of the linear combination I(t) to the time course of the total intensity of the two luminescing substances A, B is ascertained. For this purpose, the coefficient of determination $R^2$ is used, it being preferred when the coefficient of determination $R^2$ is above the threshold value 0.9, preferably above the threshold value 0.95. In the present case, the result is a coefficient of determination $R^2=0.977$.

The security marking is thus unambiguously identified (i.e. it is present), because the ratio values $M_1$, $M_2$ were assigned the attribute "ratio value was accepted" and the goodness of adaptation is above the desired threshold value. Due to the necessity of the presence of both conditions (attribute ratio value, goodness of adaptation), a particularly high reliability can be achieved upon identification of the security marking.

Figure 3:
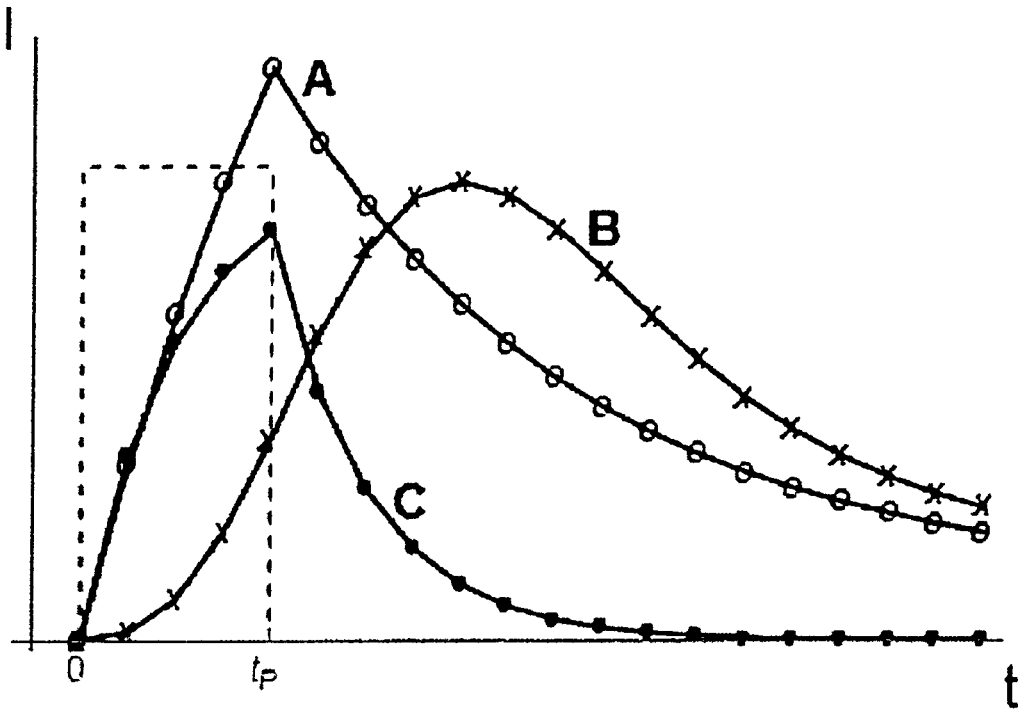
FIG. 3 time courses of the luminescence intensities of three luminescent substances A, B, C with a different, partially non-monoexponential emission behaviour.
Figure 4:
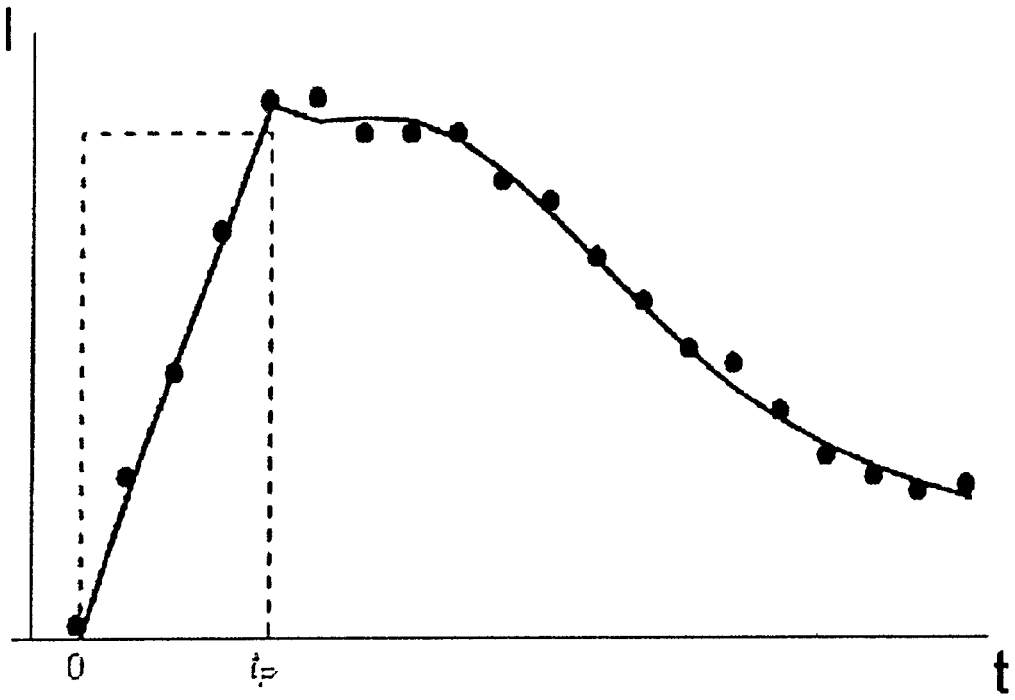
FIG. 4 a time course of the total intensity of the luminescent radiations of a combination of the luminescent substances A, B, C of FIG. 3, with adaptation curve.
Figure 5:
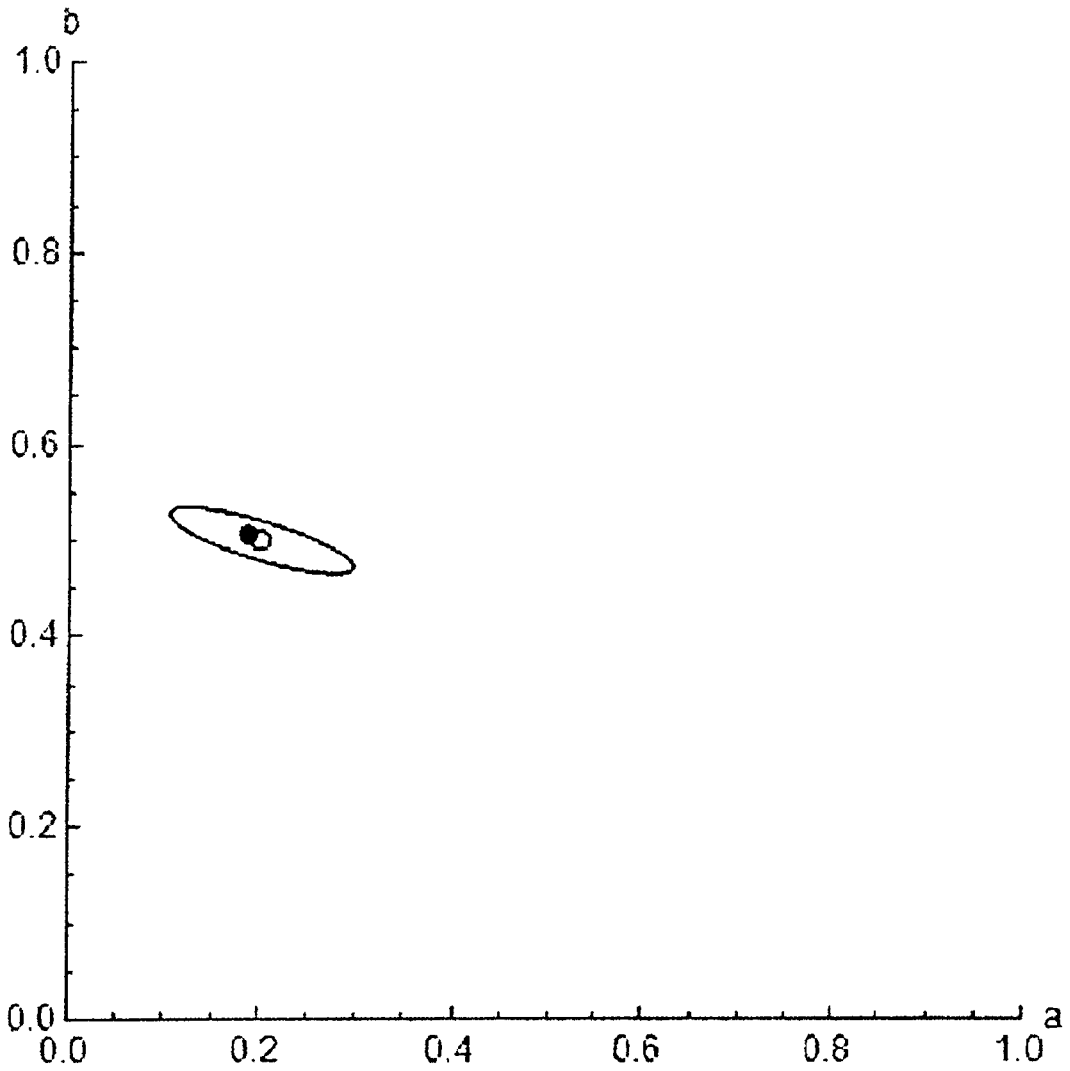
FIG. 5 a diagram for illustrating a mixture tuple (a, b) with scatter region for the mixture of three luminescent substances of FIG. 4.

Referring to FIGS. 3 to 5, another embodiment example is explained. In order to avoid unnecessary repetitions, merely the differences over the embodiment example of FIGS. 1 and 2 are explained and otherwise reference is made to the explanations there. Accordingly, a security marking having three combined luminescent substances A, B, C which are jointly excited by a same excitation pulse is viewed. The luminescent substances A, B correspond to those of FIG. 1, the luminescent substance C is additionally added. As recognizable in the I-t diagram of FIG. 3, the time courses of the intensities of the emitted luminescence radiations strongly differ from each other, the luminescent substance C showing, in contrast to the luminescent substances A, B, a monoexponential emission behaviour. The measured data points are respectively connected to each other by continuous data lines.

In the mixture of the luminescent substances, the mixture shares of the luminescent substances A, B, C are, in this order, 20%, 50%, 30%, in each case based on the total quantity of luminescent substances. The mixing ratio A/B/C thus is 20%/50%/30%. The combined intensity behaviour was measured with a signal-to-noise ratio of approx. 20. The measurement data are represented in FIG. 4. Subsequently, the above-mentioned linear combination is adapted to the general formula A having three base vectors $I_A(t)$, $I_B(t)$, $I_C(t)$, as shown in FIG. 3, the linear coefficients $c_1$, $c_2$, $c_3$ being determined by the method of least squares. One recognizes a good adaptation of the adaptation curve to the data points in spite of the visually clearly recognizable noise component. The evaluation yields relative mixture shares of the luminescent substances A, B, C, in this order, of 18.8%, 50.7%, 30.5%, in each case based on the total quantity of luminescent substances. For an identification of the security marking, the ascertained linear coefficients $c_1$, $c_2$, $c_3$ are combined as 3-tuple ($c_1$, $c_2$, $c_3$) and converted into the scaling-independent ratio values $M_1=c_1/(c_1+c_2+c_3)$, $M_2=c_2/(c_1+c_2+c_3)$. For the third linear coefficient $c_3$, the associated ratio value $M_3$ results from $M_3=1-(M_1+M_2)$. Subsequently, it is checked for two ratio values $M_1$, $M_2$ whether the ratio values are within an associated, definable or defined (predetermined) values range $W_1$, $W_2$, corresponding to scatter regions of the preknown mixture shares, i.e. the distance of the mixture tuple ($c_1/(c_1+c_2+c_3)$, $c_2/(c_1+c_2+c_3)$) from the reference coordinates formed from the original mixture composition is ascertained.

For an easy check of the position of the measured mixture tuple relative to the preknown mixture tuple, in an a-b plane there is defined a, for example, elliptically formed tolerance region (see FIG. 5). This can be extended differently in different directions, which is due to the shape of the temporal intensity behaviour. In FIG. 5, the measured mixture tuple is represented by the filled circle, the target value (preknown mixture tuple) by the empty circle.

For two ratio values $M_1$, $M_2$ there is then effected an assignment of the attribute "ratio value accepted", if the ratio value is within the associated values range, or the attribute "ratio value not accepted", if the ratio value is outside the associated values range.

In the present case, the two ratio values $M_1$, $M_2$ are within associated values ranges $W_1$, $W_2$, whereby, within the frame of the scatter, the correct, i.e. preknown relative mixture shares of the two luminescent substances A, B were ascertained respectively based on the total quantity of the luminescent substances A, B, C.

Furthermore, the coefficient of determination $R^2$ was ascertained which in the present case is $R^2=0.9989$, whereby it was shown that it is clearly above the preferred threshold values.

As a result, it can be established that the security marking has the preknown composition, thus the security marking having been identified.

Figure 6:
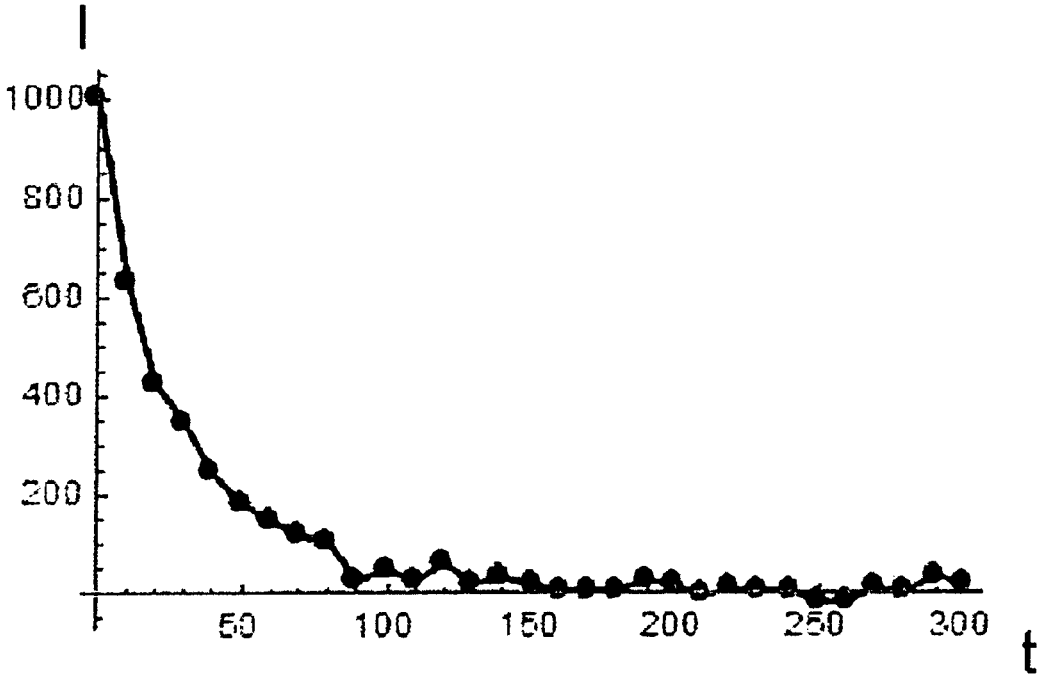
FIG. 6 upper image: simulated time course of the luminescence intensity of a combination of luminescent substances with a defined noise component during the decay phase; lower image: dependence of the relative mixture share on the size of the noise component.
Figure 6:
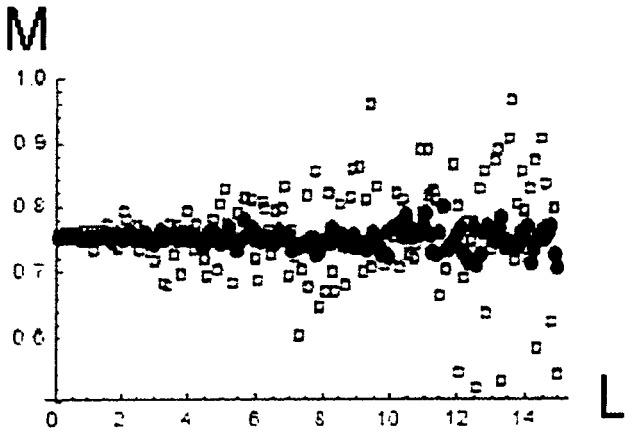

Now, reference is made to FIG. 6, upper image. For examining the noise sensitivity of the method according to the invention, at one decay curve of a mixture from two luminescent substances with monoexponential decay behaviour differently normal-distributed noise components were added to the measuring points. There was effected an evaluation with a linear adaptation method according to the present invention and with a non-linear adaptation method known in the prior art. In FIG. 6, lower image, the evaluation is illustrated in a diagram in which the relative mixture share of a luminescent substance is plotted against the noise level. Upon determining the relative mixture share according to the invention there recognizably shows up a lower noise susceptibility in comparison to the method known in the prior art. For the non-linear method in the viewed interval of the noise level, there recognizably exists an approximately linear relation between the scatter range of the ascertained mixture share and the noise level. However, the linear adaptation method shows up stably with a scatter range of 0.05 (absolute) of the mixture share. These results suggest that already with low noise components non-linear adaptation methods do no longer deliver reliable results, while the linear adaptation method according to the invention functions sufficiently reliably in the viewed intensity interval.

Figure 7:
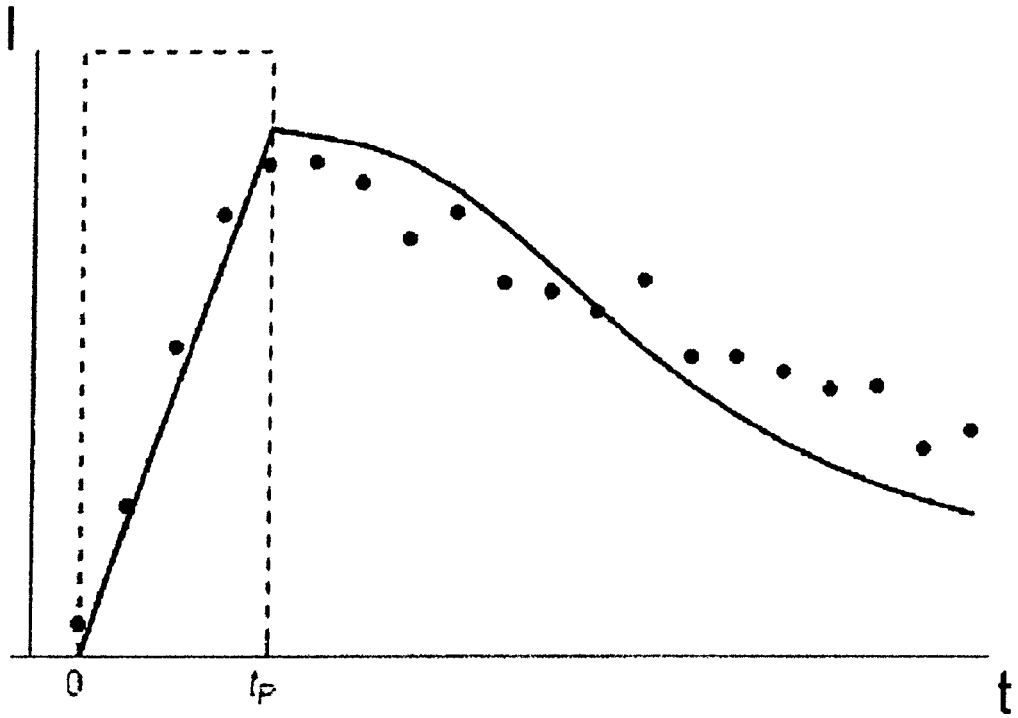
FIG. 7 time course of the total intensity of the emitted radiation of a mixture of two luminescent substances with a different, monoexponential emission behaviour for illustrating a forgery attempt, with adaptation curve.

FIG. 7 shows the time behaviour of a monoexponentially decaying luminescent substance which, for example, could be used for a forgery attack. The adaptation curve ascertained by the method according to the invention is represented with a solid line. If it is assumed, that the security marking includes the two luminescent substances A, B, there then result the mixture shares 61.2% and 37.8% as well as an adaptation goodness of $R^2$=0.793. Because of the adaptation goodness being far below the threshold value of preferably 0.9, the security marking is not identified.

Figure 8:
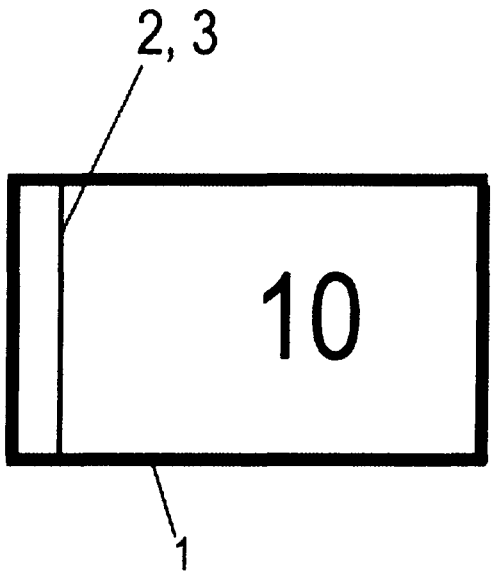
FIG. 8 a value document with a tracer thread which has a security marking.

FIG. 8 shows a value document 1 configured, for example, in the form of a bank note which has a tracer thread 2 with a security marking 3. The security marking 3 can be configured as described above.

As results from the above description, the invention offers great advantages over the evaluating methods with non-linear adaptation known in the prior art in which besides the amplitudes of the temporal intensity spectra also the decay times are used as model parameters. In particular there can be obtained by the method according to the invention with given time behaviour (in particular decay curves) a much faster and more stable evaluation (i.e. faster convergence behaviour of the adaptation routine) for the luminescent substances employed in combination, both for clean intensity measurements and for intensity measurement exhibiting noise. A quantitative evaluation results in a computing time reduced by approx. 3 orders of magnitude in comparison to the non-linear adaptation known in the prior art what makes clear the efficiency increase with respect to the evaluation speed. In time-critical cases of application, a fast evaluating method is essential, for example for the analysis in high-speed bank note processing machines with bank notes moved with up to 12 m/s, because these substantially determine the processing speed.

LIST OF REFERENCE SIGNS

1 value document
2 tracer thread
3 security marking

The invention claimed is:

1. A value document having a security marking in the form of at least two luminescing substances, wherein the at least two luminescing substances are respectively present in a defined relative quantitative share, based on the total quantity of the at least two luminescing substances, the at least two luminescing substances are jointly excitable by one excitation pulse, time courses of intensities of emitted radiations of the at least two luminescing substances are different from each other, and at least one luminescing substance of the at least two luminescing substances has a non-monoexponential time course of the intensity of the emitted radiation of the at least one luminescing substance.

2. The value document according to claim 1, in which the at least two luminescing substances have overlapping, in particular identical, excitation spectra.

3. The value document according to claim 1, in which the at least two luminescing substances have overlapping emission spectra.

4. The value document according to claim 1, in which the security marking has luminescing substances whose time courses of the intensities of the emitted radiations have a Bray-Curtis distance of greater than 0.10.

5. The value document according to claim 1, in which the at least two luminescing substances respectively have an intensity of the emitted radiation which is in the region of 5% to 95%, of the total intensity of the emitted radiations of the luminescing substances.

6. The value document according to claim 1, in which the at least two luminescing substances respectively have a decay time in the region of 100 ns to 100 ms.

7. The value document according to claim 1, in which at least one luminescing substance comprises a host lattice doped with at least one rare-earth metal and/or at least one transition metal.

8. A method for identifying the security marking of a value document according to claim 1, which comprises the following steps:

i) jointly exciting the luminescing substances with one excitation pulse, ii) detecting the time course of a total intensity of the emitted radiations of the luminescing substances, iii) adapting a linear combination I(t) of the formula $$I(t) = \sum_{i=1}^{n} c_i \cdot I_i(t)$$

to the time course of the total intensity of the emitted radiations, wherein $I_i(t)$ are time courses of the intensities of the radiations emitted by the luminescing substances and $c_i$ are linear coefficients, wherein the index i relates to the luminescing substances and n indicates the number of luminescing substances, wherein the linear coefficients $c_i$ are ascertained, and iv) identifying the security marking on the basis of the linear coefficients $c_i$.

9. The method according to claim 8, in which in step iii) the linear coefficients $c_i$ are determined such that absolute deviations of the linear combination I(t) from data points of the time course of the detected total intensity are minimized.

10. The method according to claim 9, in which the linear coefficients $c_i$ are determined by the method of least squares such that the sum of the square deviations of the linear combination I(t) from data points of the time course of the detected total intensity of the emitted radiations are minimized.

11. The method according to claim 8, in which step iv) comprises the following substeps:

iv-1) for n−1 linear coefficients $c_i$: respectively ascertaining a ratio value $M_i$ for each linear coefficient $c_i$, which results from the ratio of the linear coefficient $c_i$ to at least one further linear coefficient $c_i$ or to a sum of $c_i$ and at least one further linear coefficient $c_i$, iv-2) for each ratio value $M_i$: checking whether the ratio value $M_i$ is within an associated, definable or defined values range $W_i$, iv-3) for each ratio value $M_i$: assigning the attribute "ratio value accepted", if the ratio value $M_i$ is within the associated values range $W_i$, or the attribute "ratio value not accepted", if the ratio value $M_i$ is outside the associated values range $W_i$, iv-4) identifying the security marking, if all ratio values $M_i$ have been assigned the attribute "ratio value accepted".

12. The method according to 11, in which in step iv-1) the ratio $M_i$ is ascertained by the ratio of the associated linear coefficient $c_i$ to the sum of all linear coefficients $c_i$.

13. The method according to claim 8, which has a further step v) which comprises the following substeps:

v-1) ascertaining a measure value G characterizing the goodness of the adaptation of the linear combination I(t) to the time course of the total intensity of the luminescing substances, v-2) comparing the measure value G with a threshold value, v-3) assigning the attribute "measure value accepted" to the measure value G, if the measure value G is greater than the threshold value, or the attribute "measure value not accepted", if the measure value G is smaller than or equal to the threshold value, and v-4) identifying the security marking, if the measure value G has been evaluated with the attribute "measure value accepted".

14. The method according to claim 13, in which the measure value G is the coefficient of determination $R^2$, wherein the threshold value is 0.9.

15. The method according to claim 8, in which in step ii) more data points for detecting the total intensity are captured in a first time period immediately following the switching-off of the excitation pulse than in a second time period immediately following the first time period, wherein the first time period and the second time period are of equal length.

* * * * *